US005474871A

United States Patent [19]

Takagi et al.

[11] Patent Number: 5,474,871

[45] Date of Patent: Dec. 12, 1995

[54] PROCESS FOR MAKING MAGNETIC TONERS

[75] Inventors: Seiichi Takagi; Toyofumi Inoue; Teruo Masukawa, all of Minami-ashigara, Japan

[73] Assignee: Fuji Xerox Co., Ltd, Tokyo, Japan

[21] Appl. No.: 338,863

[22] Filed: Nov. 14, 1994

Related U.S. Application Data

[62] Division of Ser. No. 4,260, Jan. 14, 1993, abandoned.

[30] Foreign Application Priority Data

Jan. 20, 1992 [JP] Japan ..... 4-27453

[51] Int. Cl.[6] ..... G03G 9/083

[52] U.S. Cl. ..... 430/137

[58] Field of Search ..... 430/110, 904, 430/106, 137

[56] References Cited

U.S. PATENT DOCUMENTS

| | | | |
|---|---|---|---|
| 4,849,316 | 7/1989 | Kawasaki et al. | 430/110 |
| 5,051,331 | 9/1991 | Sakashita | 430/109 |
| 5,135,833 | 8/1992 | Matsunaga et al. | 430/106.6 |
| 5,268,248 | 12/1993 | Tanikawa et al. | 430/106.6 |

FOREIGN PATENT DOCUMENTS

| | | |
|---|---|---|
| 52-3304 | 2/1977 | Japan . |
| 59-17750 | 4/1984 | Japan . |
| 59-231547 | 4/1984 | Japan . |
| 59-174856 | 5/1984 | Japan . |
| 59-174854 | 6/1984 | Japan . |
| 60-93457 | 2/1985 | Japan . |
| 2-5072 | 5/1990 | Japan . |
| 2-251968 | 6/1990 | Japan . |
| 3-168649 | 3/1991 | Japan . |

*Primary Examiner*—John Goodrow
*Attorney, Agent, or Firm*—Oliff & Berridge

[57] ABSTRACT

A magnetic toner comprising a binder resin a magnetic substance is disclosed, the toner containing from 2 to 20% by weight of a polyolefin, preferably polyethylene, having a dispersed particle size of from 0.01 to 0.5 μm. The particle size distribution of the polyolefin preferably has a coefficient of variation of from 20 to 40%. The magnetic toner is fixable with low heat energy, hardly causes offset and smudge, and has a reduced abrasive action on a photoreceptor. It is therefore suitable for use in a fixing means with no cleaning mechanism, a machine with a double side copying function, or an organic photoreceptor.

13 Claims, No Drawings

PROCESS FOR MAKING MAGNETIC TONERS

This is a division of application Ser. No. 08/004,260 filed Jan. 14, 1993, now abandoned.

FIELD OF THE INVENTION

This invention relates to magnetic toner for development of an electrostatic latent image and more particularly to a magnetic toner suitable for an image forming apparatus having a heat-fixing mechanism, such as a heat roll.

BACKGROUND OF THE INVENTION

Dry development in current electrostatic copying systems is divided into a two-component development system using a toner and a carrier, e.g., iron powder, and a magnetic one-component development system using a toner containing therein a magnetic substance. The development system using a one-component magnetic toner is advantageous over the two-component development system in that an automatic concentration controller as used in a developing machine according to the two-component development system is not necessary, thus making the machine compact and that contamination of a carrier is not involved, excluding the necessity of such maintenance as carrier exchange. On account of these advantages, the one-component development system has been spreading in not only low-speed small-sized copying machines or printers but middle- to high-speed (15 copies per minutes or more) copying machines or printers, and even more improvements in performance have been expected.

However, containing 30 to 70% by weight of a magnetic substance in general, the magnetic toner essentially has poorer fixing properties than the two-component type toners which usually contain no magnetic substance and therefore needs higher heat energy for fixing than in the two-component development system. In recent years, middle- to high-speed copying machines have undergone digitization and acquired various functions. This means that the energy allotted to a fixing means has been decreasing. To cope with this tendency, the demand for low temperature fixing of a magnetic toner has become more strict.

On the other hand, there has been an ever-increasing demand for downsizing of a copying machine itself, and studies have been directed to size reduction of not only a developing machine but a fixing means. In particular, omission of a cleaning mechanism from a fixing means, which would exclude the necessity of a winding type web or a disposable pad that has been conventionally used, has become a very important subject from the standpoint of resources saving.

Omission of a cleaning mechanism may be achieved chiefly by improving non-offset properties of a toner. In this connection, a magnetic toner involves a serious disadvantage as compared with two-component type toners containing no magnetic substance. That is, the magnetic substance contained in a magnetic toner causes many fine scratches on the surface of a fixing roller during long-term use, resulting in deterioration of the non-offset properties. The formation of fine scratches on a fixing roll is an essential problem associated with a magnetic toner containing a magnetic substance. It has therefore been demanded to develop a magnetic toner having improved non-offset properties.

Further, middle- to high-speed copying machines with a double side copying function have prevailed from the need of resources saving. Double side copying is generally carried out by once making a desired number of single-sided copies, collecting the copies on a tray in the machine, and forming an image on the reverse of the single-sided copies. In order to feed the single-sided copies one by one in an accurate manner from the tray, the rest of the single-sided copies must be held under very strong pressure. It follows that the toner image of a copy fed or the next copy which should remain on the tray received strong rubbing to cause an image smudge. This phenomenon becomes conspicuous with an increase in copying speed. Since the image made of a magnetic toner contains a magnetic substance not only in the inside of toner particles but in the vicinity of the surface thereof, it is less resistant against rubbing than the image made of toner particles containing no magnetic substance. Accordingly, the magnetic toner applied to copying machines with a double side copying function should have satisfactory resistance to rubbing (hereinafter referred to as smudge resistance).

With respect to an electrophotographic photoreceptor used in copying machines or printers, organic photoreceptors (hereinafter abbreviated as OPC) are now prevalent, which appears to be favorable for safety. However, OPC has a resin surface, it readily wears and is difficult to apply to high-speed machines. In using a magnetic toner, in particular, the very hard magnetic substance exerts an abrasive action on OPC to accelerate wear of the surface of OPC. From this point of view, too, a magnetic toner is deemed obviously inferior to two-component type toners containing no magnetic substance.

In order to improve the fixing ability of toners, various proposals have been made to date. For example, JP-B-52-3304 (the term "JP-B" as used herein means an "examined published Japanese patent application") discloses a toner containing a colorant, a styrene resin and a low molecular weight polypropylene for the two-component development system. Incorporation of the low molecular weight polypropylene produces an improving effect on fixing but is still insufficient for meeting the latest strict demands. In particular, the proposal fails to satisfy the even more strict demands for a magnetic toner such that the toner should be applicable to a fixing means having substantially no cleaning mechanism, the toner should not cause smudges in double side copying, and the toner should not make scratches on a photoreceptor susceptible to abrasion, such as OPC.

In an attempt to improve theses performance properties of a magnetic toner, the amount of polyolefin such as polypropylene to be incorporated might be increased. However, while a magnetic toner in a magnetic one-component development system must be charged through friction with a toner-carrying member and be electrically attracted to the toner-carrying member to form a thin film, a polyolefin when added in an increased amount forms a thin film (called filming) on the surface of the toner-carrying member, which seriously impairs developing performance. Such a filming phenomenon of a polyolefin is attributed to poor dispersibility of a polyolefin in the toner. That is, since a polyolefin is non-polar, high crystalline, and thereby incompatible with the binder resin of the toner, it apt to agglomerate to be localized in the individual toner particles or to form independent polyolefin particles.

Besides, a polyolefin having such poor dispersibility causes broadening of the distribution of the toner charge quantity and narrowing of fog latitude, which often develops problems on practical use.

Hence, if a large amount of a polyolefin is used for the purpose of improving fixing, non-offset properties, and smudge resistance, it is very difficult to avoid the above-mentioned problems of developing properties with a one-component type toner.

To settle down these problems, it has been proposed to incorporate a polyolefin into a toner in combination with an oxidized wax or a polar group-containing wax as disclosed, e.g., JP-A-59-177570 (the term "JP-A" as used herein means an "unexamined published Japanese patent application"). According to the proposal, it appears that the polyolefin is made compatible with a binder resin of a toner owing to an oxidized wax to exhibit increased dispersibility thereby bringing some improvements. However, even if a considerably large quantity of an oxidized wax be added, the effects are not sufficient for eliminating the above-described problems, probably and partly because the polyolefin is not dispersed to a sufficient degree as necessary.

In addition, the amount of the oxidized wax to be added is limited because it adversely affects developing properties while making almost no contribution to fixing. Therefore, the combined use of an oxidized wax does not afford the means of solving the problems accompanied by the addition of an increased amount of a polyolefin.

Thus, a magnetic toner free from all the above-mentioned disadvantages has not yet been developed.

SUMMARY OF THE INVENTION

An object of the present invention is to provide a magnetic toner which is fixable with low heat energy.

Another object of the present invention is to provide a magnetic toner which causes no offset even when applied to a copying machine whose fixing means is not fitted with a cleaning mechanism.

A further object of the present invention is to provide a magnetic toner which exhibits excellent smudge resistance even when applied to a copying machine having a double side copying function.

A still further object of the present invention is to provide a magnetic toner which as a reduced abrasive action and can be applied to a machine using a photoreceptor susceptible to abrasion, such as OPC.

A yet further object of the present invention is to provide a magnetic toner which has sufficiently broad fog latitude for practical use.

As a result of extensive investigations, the inventors have found that the above objects of the present invention are accomplished by controlling the amount and diameter of dispersed polyolefin particles in a toner and that the effects are pronounced by using polyethylene amongst polyolefins. They also have found that the improving effects are even more heightened by controlling the polyolefin dispersed particle size distribution so that the coefficient of variation may fall within a specific range.

The present invention relates to a magnetic toner comprising a binder resin and a magnetic substance, said toner containing from 2 to 20% by weight of a polyolefin having a dispersed particle size of from 0.01 to 0.5 μm.

In a preferred embodiment of the present invention, the polyolefin is polyethylene.

In another preferred embodiment of the present invention, the polyolefin has a dispersed particle size distribution with a coefficient of variation ranging from 20 to 40%.

DETAILED DESCRIPTION OF THE INVENTION

In conventional polyolefin-containing toners, the dispersed polyolefin particles have a particle diameter of several microns. In some cases, the toner contains independent polyolefin particles having approximately the same size as toner particles. The inventors'0 examination on these conventional polyolefin-containing toners has revealed that dispersion of a polyolefin is very non-uniform, largely varying depending on toner particles and that existence of a considerable proportion of toner particles having an insufficient polyolefin content results in an insufficient improvement in fixing properties or poor slip between the toner and a photoreceptor. It has also turned out that such a poorly dispersible polyolefin gives rise to various problems with respect to development. It has also been revealed, on the other hand, that mere size reduction of the polyolefin particles leads to an improvement in developing properties but, in turn, results in deterioration of fixing characteristics and smudge resistance of the toner and also easy wear of a photoreceptor. An attempt to avoid these disadvantages by increasing the amount of the polyolefin has been attended by deterioration of developing properties. Thus, use of polyolefins in a magnetic toner has failed to satisfy all the requirements.

The inventors have conducted systematical investigations on the dispersed particle size and content of a polyolefin and found, as a result, that the requirements for a magnetic toner can be simultaneously and fully satisfied by dispersing a specific amount of a polyolefin in a toner in the form of far finer particle than that having hitherto been deemed proper. In particular, it has been found that various performance properties of a magnetic toner are influenced by not only the dispersed particle size and content of the polyolefin but the kind of the polyolefin and the coefficient of variation of the size distribution of the polyolefin particles.

In the present invention, the dispersed particle size of polyolefin should range from 0.01 to 0.5 μm, preferably from 0.01 to 0.3 μm, more preferably from 0.02 to 0.2 μm, and most preferably from 0.03 to 0.1 μm. If it is less than 0.01 μm, the smudge resistance is reduced. If it exceeds 0.5 μm, the development performance cannot be maintained stably in high-speed machines, and wear of a photoreceptor results.

The polyolefin content in a toner should ranges from 2 to 20% by weight, preferably from 2 to 15% by weight, more preferably from 2 to 10% by weight, and most preferably from 2.5 to 7% by weight. With a lower polyolefin content, sufficient smudge resistance cannot be obtained. With a higher content, developing properties are deteriorated.

While any of known polyolefins can be used in the present invention, polyethylene is especially preferred from the standpoint of smudge resistance and suppression of wear of a photoreceptor.

It is preferable that the size distribution of the polyolefin has a coefficient of variation of from 20 to 40%, more preferably from 25 to 40%, and most preferably from 25 to 35%. In this case, development stability in high-speed machines can further be improved, the fog latitude is further broadened, and the non-offset properties can further be improved. If the coefficient of variation is below 20, smudge resistance tends to be reduced. If it exceeds 40%, development stability tends to be reduced.

The terminology "coefficient of variation" of a dispersed particle size distribution as used herein is a value calculated from equation: (standard deviation/mean particle size)×100.

The dispersed particle size of polyolefin and the coefficient of variation of the distribution thereof may be determined by slicing a toner particle with a cutter, e.g., a microtome, to a thickness of 0.3 μm, taking a micrograph of the section with a transmission electron microscope (TEM) at a magnification of 9000, choosing about 100 polyolefin particles at random, and analyzing and digitizing the particles by means of an image analyzer.

Various methods may be employed for dispersing a polyolefin in a magnetic toner to the above-specified particle size. For example, a polyolefin is dispersed in a binder resin for a toner in the presence of a low-molecular weight polymer preferably having a weight average molecular weight of from 1,000 to 10,000, more preferably from 3,000 to 8,000, to obtain a resin composition which is then melt-blended with a magnetic substance. The low-molecular weight polymer is preferably present in such an amount that the polymer accounts for 40 to 60%, preferably 45 to 55% of the peak area of the molecular distribution curve of the resulting resin composition when measured by gel permeation chromatography (GPC). Preferred low-molecular weight polymers are those of monomers exemplified for the monomer component of the binder resin described below, or graft- or block-copolymers of the polyolefin with other monomer(s) (e.g., styrene or derivative thereof and acrylic monomers as exemplified for the monomer component of the binder resin).

Dispersion of a polyolefin to a desired particle size is preferably effected in two steps as follows. In a first step, a polyolefin is previously dispersed in a binder resin to a particle size of not more than about 3 μm. The polyolefin may be dispersed in a system for producing a binder resin, for example, at the time of polymerization or in a molten binder resin by using a block or grafted polymer as a dispersing agent. More specifically, a polyolefin powder is dissolved in a solution containing a monomer for the binder resin in a solvent and graft polymerization is carried out using a polymerization initiator. Alternatively, a polyolefin powder is dissolved in a solution containing a binder resin, together with a graft polymer of the monomer of the binder resin and a vinyl monomer as a dispersing agent. While the binder resin may be a resin having two molecular weight distribution peaks corresponding to a low molecular weight polymer component and a high molecular weight component for the sake of control of its fixing temperature, the polyolefin is preferably incorporated in a system for producing the low molecular weight component of the binder resin in the same manner as described above. In a second step, a commonly employed procedure for producing a toner is adopted. Prior to the second step, a solvent used in the first step is removed from the resin solution obtained in the first step. Dispersion of the polyolefin in the second step is effected simultaneously with blending and dispersion of a magnetic substance, etc. by means of a roll mill, an extruder, and so on. In the second step, the polyolefin is finely dispersed to a final particle size of not more than 0.5 μm. An additional amount of a polyolefin, either the same as or different from that added in the first step, may be added in the second step. When the above-mentioned two-molecular weight peak binder resin is used, the polyolefin to be added in the second step is preferably added to the resin solution of the first step together with a high molecular weight component of the binder resin that is separately prepared by bulk polymerization, solution polymerization and the like, and then the solvent of the resin solution is removed, followed by dispersion of the polyolefin. In this case, the weight ratio of the polyolefin added in the first step to that added in the second step preferably ranges from 10:1 to 1:10 and more preferably from 1:10 to 5:10.

The coefficient of variation as defined in the present invention can be attained when the polyolefin is dispersed in a binder resin in the above-mentioned two-step process. The coefficient of variation can be reduced by adding the polyolefin(s) in the first and second steps in the preferred weight ratio of 1:10 to 5:10.

Binder resins which can be used in the magnetic toner of the present invention include vinyl polymers, i.e., homo- or copolymers of one or more vinyl monomers. Typical examples of suitable vinyl monomers include styrene or derivatives thereof, e.g., p-chlorostyrene and vinylnaphthalene; ethylenically unsaturated monoolefins, e.g., ethylene, propylene, butylene and isobutylene; vinyl chloride, vinyl bromide, vinyl fluoride; vinyl esters, e.g., vinyl acetate, vinyl propionate, vinyl benzoate, vinyl butyrate, vinyl formate, vinyl stearate, and vinyl caproate; ethylenic monocarboxylic acids or esters thereof, e.g., methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate, and butyl methacrylate; methylenic monocarboxylic acid derivatives, e.g., acrylonitrile, methacrylonitrile, and acrylamide; ethylenic dicarboxylic acids and esters thereof, e.g., dimethyl maleat, diethyl maleate, and dibutyl maleat; vinyl ketones, e.g., vinyl methyl ketone, vinyl hexyl ketone, and methyl isopropenyl ketone; vinyl ethers, e.g., vinyl methyl ether, vinyl isobutyl ether, and vinyl ethyl ether; vinylidene halides, e.g., vinylidene chloride and vinylidene chlorofluoride; and N-vinyl compounds, e.g., N-vinylpyrrole, N-vinylcarbazole, N-vinylindole, and N-vinylpyrrolidone.

Polyester resins may also be used as a binder resin either independently or in combination with the vinyl polymers.

The binder resin preferably has a number average molecular weight (Mn) of from 2,000 to 10,000 and a weight average molecular weight (Mw) of from 20,000 to 200,000 when measured by the GPC method, and a glass transition temperature (Tg) of from 55° to 75° C. (more preferably from 60° to 70° C.). In the case of the two-molecular weight peak binder resin having two-molecular weight distribution peaks as described above, the peak of the low-molecular weight component is generally within the range of from 1,000 to 10,000, (preferably from 3,000 to 8,000) when measured by the GPC method. The two-molecular weight peak binder resin preferably has Tg of from 55° to 75° C. and preferably from 60° to 70° C.

The magnetic toner of the present invention may contain various additives for the purpose of charge control, resistivity control, and the like. For example, the toner may contain fluorine type surface active agents, chrome dyes (e.g., chromium-salicyclic acid complexes), high polymer acids (e.g., copolymers containing maleic acid units), quaternary ammonium salts, azine dyes (e.g., nigrosin), carbon black, and the like.

For the purpose of improving durability, fluidity, or cleanability of the toner, the toner may further contain an inorganic fine powder, e.g., silica; an organic fine powder, e.g., fatty acids or derivatives thereof and metallic salts; and a resin fine powder, e.g., fluorine resins, acrylic resins and styrene resins.

Any of conventional magnetic substances can be used in the present invention.

The content of the magnetic substance preferably ranges from 30 to 70% by weight, and more preferably from 35 to 60% by weight. If the magnetic substance content is less than 30% by weight, it is difficult to control the charge quantity, and fog may result. In particular, under a low temperature and low humidity condition, a reduction in image density or uneven development may occur. If the magnetic substance content is more than 70% by weight, the image density is reduced in a high temperature and high humidity condition.

In the present invention, the particle size of the magnetic toner was measured with a Coulter counter "TA-II" manufactured by Coulter Counter Co. at an aperture of 100 μm.

While not limiting, the toner is preferably prepared by a grinding system in which constituting components, such as a binder resin, a magnetic substance, and a colorant, are melt-kneaded in a hot kneading machine, and the mixture is cooled and ground, followed by classification.

The present invention is now illustrated in greater detail with reference to Examples, but it should be understood that the present invention is not construed as being limited thereto. All the percents, parts, and ratios are by weight unless otherwise indicated.

SYNTHESIS EXAMPLE 1

| | |
|---|---|
| Xylene | 1000 g |
| Styrene monomer | 560 g |
| n-Butyl acrylate | 140 g |
| Di-t-butyl peroxide | 0.3 g |
| Polyethylene (Mn = 3000) | 10 g |

The above materials were put in a 3 l reaction vessel and heated to 150° C. to conduct solution polymerization. There was obtained a xylene solution of a low-molecular styrene-acrylate copolymer containing a slight amount of a polyethylene-grafted styrene-acrylate copolymer. The copolymer had a weight average molecular weight (Mw) of 5,600.

In the resulting xylene solution were dissolved 300 g of a styrene-n-butyl acrylate copolymer (styrene:n-butyl acrylate=80:20; Mw=800,000) which had been separately synthesized by suspension polymerization and 60 g of the same polyethylene as used above. Thereafter, xylene was removed at about 210° C. to obtain a resin composition having dispersed therein polyethylene having a particle size of 0.1 to 0.2 μm.

SYNTHESIS EXAMPLE 2

A low-molecular copolymer was prepared in the same manner as in Synthesis Example 1, except that polyethylene was not added. The resulting styrene-acrylate copolymer had an Mw of 5,800.

The following components were dissolved in the resulting xylene solution of the low-molecular styrene-acrylate copolymer.

| | |
|---|---|
| Styrene-n-butyl acrylate copolymer (80:20; Mw = 600,000; prepared by suspension polymerization) | 300 g |
| Polyethylene (Mn = 3,000) | 70 g |
| Styrene-ethylene graft copolymer ("G 1701 X" produced by Shell Chemical Co., Ltd.) | 25 g |

Xylene was removed from the mixture at about 210° C. to obtain a resin composition having dispersed therein polyethylene having a particle size of 0.1 to 0.3 μm.

SYNTHESIS EXAMPLE 3

A resin composition was prepared in the same manner as in Synthesis Example 1, except for using no polyethylene.

EXAMPLE 1

| | |
|---|---|
| Resin composition of Synthesis Example 1 | 49% |
| Magnetite (average particle size: 0.25 μm) | 50% |
| Positive charge control agent ("Bontron P-51" produced by Orient Chemical Co., Ltd.) | 1% |

The above materials were dry blended in a Henschel mixer and heat-kneaded in an extruder set at 140° C. After cooling, the blend was coarsely broken and then finely ground to obtain particles having a 50% volume diameter $D_{50}$ of 8.8 μm. The particles were classified to obtain particles having a $D_{50}$ of 9.5 μm comprising 11 v/v % of those no greater than 5 μm and 0.5 v/v % of those no smaller than 20 μm. The coefficient of variation of size distribution of polyethylene was 32% , and an average particle size of polyethylene was 0.3 μm. The resulting particles were mixed with 0.3% of hydrophobic colloidal silica in a Henschel mixer to prepare a magnetic toner.

The magnetic toner was evaluated with a copying machine "VIVACE 200" (manufactured by Fuji Xerox Co., Ltd.) from which a cleaning mechanism of the fixing means had been removed.

COMPARATIVE EXAMPLE 1

A magnetic toner was prepared in the same manner as in Example 1, except for replacing the resin composition of Synthesis Example 1 with the resin composition of Synthesis Example 3 and adding 3.5 parts of polyethylene per 100 parts of the toner. The polyethylene had an average particle size of 3.0 μm with its coefficient of variation of the size distribution being 57%.

The resulting magnetic toner had a $D_{50}$ of 9.4 μm, containing 12 v/v % of particles no greater than 5 μm and 0.8 v/v % of particles no smaller than 20 μm.

The magnetic toner was evaluated in the same manner as in Example 1.

EXAMPLE 2

| | |
|---|---|
| Resin composition of Synthesis Example 1 | 49.5% |
| Magnetite (average particle size: 0.22 μm) | 50% |
| Positive charge control agent ("Bontron S-34" produced by Orient Chemical Co., Ltd.) | 0.5% |

The above materials were mixed and ground in the same manner as in Example 1. The coefficient of variation of size distribution of polyethylene was 28%, and the average particle size of polyethylene was 0.15 μm. The particles were mixed with 0.7% of hydrophobic colloidal silica in a Henschel mixer to prepare a magnetic toner.

The resulting magnetic toner had a $D_{50}$ of 9 μm, containing 20 v/v % of particles no greater than 5 μm and 0 v/v % of particles no smaller than 20 μm.

The magnetic toner was evaluated with a printer "XP-15" (manufactured by Fuji Xerox Co., Ltd.) from which a cleaning mechanism of the fixing means had been removed.

The single-sided copies from XP-15 were put in a tray of a double side copying machine "VIVACE 500" (manufactured by Fuji Xerox Co., Ltd.), and copying on the reverse side of the single-sided copies was carried out to evaluate smudge resistance.

COMPARATIVE EXAMPLE 2

A magnetic toner was prepared in the same manner as in Example 2, except for replacing the resin composition of Synthesis Example 1 with the resin composition of Synthesis Example 3 and adding 3.5 parts of polyethylene per 100 parts of the toner. The polyethylene had an average particle size of 4.0 μm with its coefficient of variation of the size distribution being 52%.

The resulting magnetic toner had a $D_{50}$ of 9.1 μm, containing 18 v/v % of particles no greater than 5 μm and 0 v/v % of particles no smaller than 20 μm.

The magnetic toner was evaluated in the same manner as in Example 2.

EXAMPLE 3

| | |
|---|---|
| Resin composition of Synthesis Example 2 | 48% |
| Magnetite (average particle size: 0.2 μm) | 50% |
| Negative charge control agent ("Bontron E-85" produced by Orient Chemical Co., Ltd.) | 0.2% |

The above materials were mixed and ground in the same manner as in Example 1. The coefficient of variation of size distribution of polyethylene was 39%, and the average particle size of polyethylene was 0.1 μm. The particles were mixed with 0.4% of hydrophobic colloidal silica in a Henschel mixer to prepare a magnetic toner.

The resulting magnetic toner had a $D_{50}$ of 8.8 μm, containing 22 v/v % of particles no greater than 5 μm and 0 v/v % of particles no smaller than 20 μm.

The magnetic toner was evaluated with a copying machine "VIVACE 500" (manufactured by Fuji Xerox Co., Ltd.) with its developing means for two-component development being replaced with a developing means for one-component development and a cleaning mechanism of the fixing means thereof having been removed.

COMPARATIVE EXAMPLE 3

A magnetic toner was prepared in the same manner as in Example 3, except for replacing the resin composition of Synthesis Example 2 with the resin composition of Synthesis Example 3 and adding 1.5% of polyethylene. The coefficient of variation of size distribution of polyethylene was 47%, and the average particle size of polyethylene was 1.0 μm.

The resulting magnetic toner had a $D_{50}$ of 9.2 μm, containing 19 v/v % of particles no greater than 5 μm and 0 v/v % of particles no smaller than 20 μm.

The magnetic toner was evaluated in the same manner as in Example 3.

COMPARATIVE EXAMPLE 4

A resin composition having a polyethylene content of 42% was prepared in the same manner as in Example 1, except for using 350 g of the low-molecular weight polyethylene-grafted styrene-acrylate copolymer of Synthesis Example 1, 200 g of the high-molecular weight styrene-n-butyl acrylate copolymer of Synthesis Example 1, and 400 g of polyethylene. A magnetic toner was prepared using the resulting resin composition in the same manner as in Example 1. The coefficient of variation of size distribution of polyethylene was 38%, and the average particle size of polyethylene was 0.5 μm.

The resulting toner was evaluated in the same manner as in Example 1.

The results obtained in Examples 1 to 3 and Comparative Examples 1 to 4 are shown in Table 1 below.

TABLE 1

| Example No. | Fixing Temp. (°C.) | Non-offset Properties | Smudge Resistance | Stability of Image Quality (Number of Copies) | Fog | Non-abrasion on Photoreceptor |
|---|---|---|---|---|---|---|
| Example 1 | 175 | good | very good | good (150,000) | good | good |
| Compara. Example 1 | 185 | medium* | good | bad (100) | medium to bad** | medium |
| Example 2 | 158 | good | very good | good (30,000) | good | good |
| Compara. Example 2 | 170 | medium | good | bad (70) | medium to bad | medium |
| Example 3 | 187 | good | very good | good (300,000) | good | good |
| Compara. Example 3 | 195 | bad | medium | bad (50,000) | good to medium | bad |
| Compara. Example 4 | 160 | good | very good | bad (100) | bad | good |

Note:
*"Medium" means "acceptable for practical use".
**"Medium to bad" means "unacceptable for practical use".

The magnetic toner according to the present invention can be fixed with low heat energy and has sufficiently broad fog latitude for practical use. Further, the magnetic toner hardly causes offset and, even when applied to a fixing means having no cleaning mechanism, produces copies of high quality. Furthermore, having excellent smudge resistance, the magnetic toner causes no smudging even when applied to a machine with a double side copying function. In addition, the magnetic toner has its abrasive action so reduced that it is suitable for use in combination with a photoreceptor which easily wears, such as OPC.

While the invention has been described in detail and with reference to specific examples thereof, it will be apparent to one skilled in the art that various changes and modifications can be made therein without departing from the spirit and scope thereof.

What is claimed is:

1. A method for producing a magnetic toner comprising a magnetic substance and a binder resin having a high molecular weight component and a low molecular weight component, which comprises the steps of:

A. preparing a resin composition by dispersing from 2 to 20% by weight of a polyolefin in a binder resin in the presence of a low molecular weight polymer, and B. melt blending said resin composition with a magnetic substance.

2. The method as claimed in claim 1, wherein an additional amount of polyolefin is added during step B.

3. The method according to claim 2, wherein the weight ratio of the polyolefin added in step A to that added in step B ranges from 10:1 to 1:10.

4. The method according to claim 2, wherein the weight ratio ranges from 1:10 to 5:10.

5. A method as claimed in claim 1, wherein said low-molecular weight polymer contains the same monomer component as that of the binder resin.

6. A method as claimed in claim 1, wherein said low-molecular weight polymer is a graft- or block-copolymer of said polyolefin with other monomer or monomers.

7. A method as claimed in claim 6, wherein said other monomer is a styrene or acrylic monomer.

8. A method as claimed in claim 1, wherein said low-molecular weight polymer has a weight average molecular weight of from 1,000 to 10,000.

9. A method as claimed in claim 1, wherein said low-molecular weight polymer has a weight average molecular weight of from 3,000 to 8,000.

10. A method as claimed in claim 1, wherein said dispersing of a polyolefin is carried out such that the dispersed particle size of the polyolefin in the resin composition is not larger than 0.5 μm.

11. A method as claimed in claim 1, wherein said polyolefin has a dispersed particle size of 0.01 to 0.5 μm.

12. A method as claimed in claim 1, wherein said binder resin has a glass transition temperature of from 55° to 75° C.

13. A method as claimed in claim 1, wherein said polyolefin has a dispersed particle size distribution with a coefficient of variation ranging from 20 to 40%.

* * * * *